US009449579B2

(12) United States Patent
Vansickle et al.

(10) Patent No.: US 9,449,579 B2
(45) Date of Patent: Sep. 20, 2016

(54) SYSTEMS AND METHODS FOR MAPPING COLOR DATA

(71) Applicant: QUALCOMM Incorporated, San Diego, CA (US)

(72) Inventors: Gregory Allan Vansickle, Stouffville (CA); Daniel Stan, Richmond Hill (CA)

(73) Assignee: QUALCOMM Incorporated, San Diego, CA (US)

( * ) Notice: Subject to any disclaimer, the term of this patent is extended or adjusted under 35 U.S.C. 154(b) by 141 days.

(21) Appl. No.: 13/791,722

(22) Filed: Mar. 8, 2013

(65) Prior Publication Data

US 2014/0253583 A1 Sep. 11, 2014

(51) Int. Cl.
*G09G 5/02* (2006.01)
*G09G 5/06* (2006.01)

(52) U.S. Cl.
CPC ..... *G09G 5/06* (2013.01); *G09G 5/022* (2013.01); *G09G 2340/06* (2013.01)

(58) Field of Classification Search
None
See application file for complete search history.

(56) References Cited

U.S. PATENT DOCUMENTS 5,684,981 A * 11/1997 Jones ..... 345/566
6,028,683 A * 2/2000 Vondran, Jr. ..... 358/525
7,242,410 B2 7/2007 Frazer et al.
7,539,661 B2 5/2009 Wang
7,965,297 B2 6/2011 Hoppe
2002/0154764 A1* 10/2002 Ahmad ..... H04Q 1/46 379/406.12
2004/0042020 A1* 3/2004 Vondran, Jr. ..... H04N 1/6019 358/1.9
2012/0188229 A1* 7/2012 Wan et al. ..... 345/419

OTHER PUBLICATIONS

Han, "A Cost Effective Color Gamut Mapping Architecture for Digital TV Color Reproduction Enhancement," IEEE Transactions on Consumer Electronics, vol. 51, No. 1, Feb. 2005, pp. 168-174.

Selan J., "GPU Gems 2—Chapter 24. Using Lookup Tables to Accelerate Color Transformations", Sony Picture Imageworks, Retrieved from: URL: http://http.developer.nvidia.com/GPUGems2/gpugems2_chapter24.html, 2012, 18 pages.

* cited by examiner

*Primary Examiner* — Jacinta M Crawford
*Assistant Examiner* — Diane Wills
(74) *Attorney, Agent, or Firm* — Knobbe Martens Olson & Bear, LLP

(57) ABSTRACT

Described herein is a system and method that relates to mapping from one color space on a 3D cube to another, and an addressing method used to represent the data. The system organizes the data to reduce memory storage requirements, by re-using redundant information from different cube corners in a lattice structure without re-storing the same data. The lattice structure may repeat for every cube of interest.

18 Claims, 11 Drawing Sheets

| Corner | Table | Index |
|---|---|---|
| A | 2 | 0 |
| B | 3 | 1 |
| C | 0 | 3 |
| D | 1 | 1 |
| E | 6 | 0 |
| F | 7 | 1 |
| G | 4 | 3 |
| H | 5 | 1 |

105

| Corner | Table |
|---|---|
| A | 0 |
| B | 1 |
| C | 2 |
| D | 3 |
| E | 4 |
| F | 5 |
| G | 6 |
| H | 7 |

101

405

| Corner | Table | Index |
|---|---|---|
| A | 2 | 0 |
| B | 3 | 1 |
| C | 0 | 3 |
| D | 1 | 1 |
| E | 6 | 0 |
| F | 7 | 1 |
| G | 4 | 3 |
| H | 5 | 1 |

501

| B | G | R | A | B | C | D | E | F | G | H |
|---|---|---|---|---|---|---|---|---|---|---|
| 0 | 0 | 0 | 0 | 1 | 2 | 3 | 4 | 5 | 6 | 7 |
| 0 | 0 | 1 | 1 | 0 | 3 | 2 | 5 | 4 | 7 | 6 |
| 0 | 1 | 0 | 3 | 2 | 1 | 0 | 7 | 6 | 5 | 4 |
| 0 | 1 | 1 | 2 | 3 | 0 | 1 | 6 | 7 | 4 | 5 |
| 1 | 0 | 0 | 4 | 5 | 6 | 7 | 0 | 1 | 2 | 3 |
| 1 | 0 | 1 | 5 | 4 | 7 | 6 | 1 | 0 | 3 | 2 |
| 1 | 1 | 0 | 7 | 6 | 5 | 4 | 3 | 2 | 1 | 0 |
| 1 | 1 | 1 | 6 | 7 | 4 | 5 | 2 | 3 | 0 | 1 |

Corner

Table containing data for corner

Position of COI within the 2x2x2 pattern

Corner to Table conversion: 8x24 ROM or equivalent logic

FIG. 5

SYSTEMS AND METHODS FOR MAPPING COLOR DATA

FIELD OF THE INVENTION

The present invention generally relates to systems and methods for using a three dimensional Look Up Table (LUT) to map one color space to another color space. In one aspect, the invention relates to systems and methods for mapping from one color space to another by dividing the color space into three dimensional cubes.

BACKGROUND

Digital photography involves capturing color images and then converting those color images into numbers. There are many different ways to turn color images into numbers, and these may be termed "color models". For example, "RGB" is one color model that relies on the three primary colors, red, green, and blue to be mixed together in differing amounts to yield all of the remaining colors. Another color model is known as CMYK, which uses cyan (C), magenta (M), yellow (Y), and black (K), the primary colors of pigment to create all of the necessary colors.

Each of these different color models can be used to define a specific color space. For example, to create a three-dimensional representation of a color space, the amount of magenta color can be assigned to the representation's X axis, the amount of cyan to its Y axis, and the amount of yellow to its Z axis. This forms a three dimensional color space that has one three dimensional position for each possible color in the color space.

However, it is sometimes necessary to convert from one color space to another. For example, computer monitors typically display colors using an RGB color space, although the image being displayed may have been encoded using a different color space. Many current graphics processors include functions for transforming colors. However, in many cases, color transformations involve complex nonlinear functions, thus making it impractical to transform colors for large images in real time on a per pixel basis. Color look-up tables (LUTs) are used to transform input color signal representations into output color signal representations which can be applied to drive a color display. Such transformations are necessary because color displays commonly have non-linear input to output signal transformation characteristics. Ideally, for a given input value, a LUT generates a corresponding output value that precisely cancels the effects of a display's non-linearity so that colors appearing on the display accurately correspond to the colors defined by the input color signal representations. The LUT may be embedded in a hardware imaging system, or may be implemented via image processing software.

A typical LUT contains representations of different input color signals which are preselected to span the range of input drive signals that may be encountered during normal operation of the display. For each input color signal representation, the LUT also stores either a corresponding output color signal representation or information which can be used to derive a corresponding output color signal representation. As explained below, an input color signal representation is processed by extracting its closest corresponding output color signal representation from the LUT, or by using the information stored in the LUT to derive an output color signal representation which most closely corresponds to the input color signal representation. The extracted or derived output color signal representation is applied to drive the display.

Three dimensional look up tables, or "3D LUTs", have been used to map one color space on a three dimensional cube to another. For example, a 3D LUT may be used to map a sRGB image to the red, green and blue (RGB) signals required for an OLED panel or other display device that does not have the color gamut of sRGB.

SUMMARY

One embodiment is a method of mapping an input color space to an output color space. This embodiment includes receiving an input point corresponding to a first pixel to be converted from an input color space to an output color space; providing a plurality of intermediate tables comprising data coordinates corresponding to corners within a plurality of three dimensional cubes in a lattice and color transformation data associated with each corner, wherein each corner data coordinate is represented in only one table; determining which of the plurality of tables in the lattice contains data for the corners of a cube of interest having the input point; and accessing the color transformation data for the cube of interest using the determined tables.

Another embodiment is an integrated circuit for transforming input color space representations into output color space representations. This embodiment includes a plurality of intermediate tables comprising data coordinates corresponding to corners within a plurality of three dimensional cubes in a lattice and color transformation data associated with each corner, wherein each corner data coordinate is represented in only one table; instructions configured to receive an input point corresponding to a first pixel to be converted from an input color space to an output color space; instructions configured to determine which of the plurality of tables in the lattice contains data for the corners of a cube of interest having the input point; and instructions configured to determine color transformation data for the cube of interest using the determined tables.

Still another embodiment is a system for mapping an input color space to an output color space comprising: means for receiving an input point corresponding to a first pixel to be converted from an input color space to an output color space; means for providing a plurality of intermediate tables comprising data coordinates corresponding to corners within a plurality of three dimensional cubes in a lattice and color transformation data associated with each corner, wherein each corner data coordinate is represented in only one table; means for determining which of the plurality of tables in the lattice contains data for the corners of a cube of interest having the input point; and means for accessing the color transformation data for the cube of interest using the determined tables.

BRIEF DESCRIPTION OF DRAWINGS

FIG. 5 is an illustration of a corner to table conversion process according to one embodiment of the present invention.

DETAILED DESCRIPTION

Figure 1:
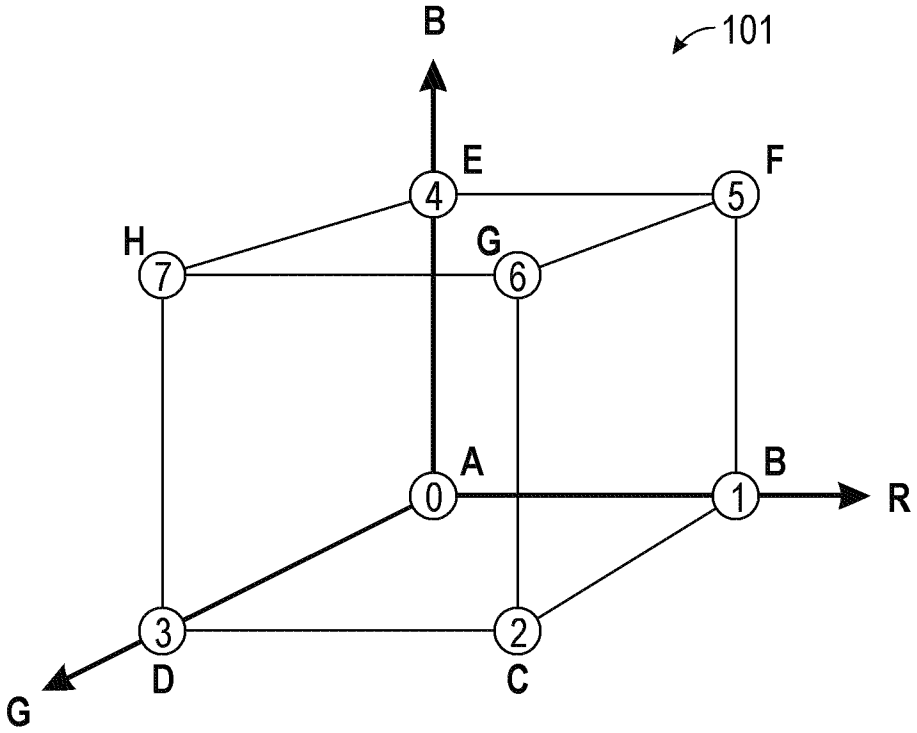
FIG. 1 is an illustration of a cube of interest, with corners and tables labeled according to one embodiment of the present invention.

Embodiments of the invention relate to systems and methods for mapping from one color space to another color space using reference to a three dimensional lookup table (3DLUT). In some embodiments, the systems and methods described herein are part of an integrated circuit, such as a graphic processing unit. One non-limiting example of such as graphics processing unit is the Adreno® integrated graphics solution that is part of the Snapdragon® line of chipsets offered from Qualcomm (San Diego, Calif.). In these embodiments, the graphics processing unit may include a memory having stored instructions for carrying out the steps described below.

As described below, the 3DLUT is used to store conversion values from a source color space to a destination color space. As described in more detail below, embodiments relate to systems and methods for representing a source color space by dividing the 3DLUT having values for converting from one color space to another color space into (N−1)×(N−1)×(N−1) basic cubes, where N is a number of grid points in each of the three directions (for red, green and blue in an RGB image). The objective is to use the lookup table to convert into a destination, or address color space. Embodiments of the invention relate to the addressing method that is used to represent the data within the 3DLUTs.

A 3DLUT is based on a three-dimensional cube, with the ability to alter a given single red, green or blue output value based on a single red, green or blue input value change. For a 3DLUT, consider an example with three axes: red ("R"), green ("G") and blue ("B"). The point where all three color planes intersect in a 3DLUT is considered to be the input point, for which an output point also exists. In an 8 bit storage system, there would be $2^8$, or 256 values per color axis, which may range in value from 0 to 255. For an input value in the form of (R,G,B) for a single pixel, each axis may range from 0 to 255, so there may be a total of $256^3$, or 16,777,216 different input combinations to cover all possible color combinations for a pixel. The objective of the 3DLUT is to map each of the input values (in this case, approximately 16 million) to an output value. Accordingly, for a single pixel that has a possible 16,777,216 different inputs, a storage system may require approximately 16 megabytes of storage space.

Embodiments of the invention are directed towards reducing the input space required by reducing the total number of input combinations (the approximately 16 million in the example discussed above). As discussed below, a mechanism has been found for optimally storing and retrieving look up data for one output component. It is thus applicable to conversion of any 3 dimensional input space to any dimensional output space (e.g. 1 for gray scale output, 3 for RGB output, 4 for CMYK output) by duplicating the method for each output component.

Instead of storing every input value along each axis (the 256 values from 0 to 255), only a few points are stored along each axis depending on the 3DLUT size. For each of the stored points along each axis, an output value is known. However, for each input value that falls in a region along an axis that does not have an input value stored, an interpolation process is used to calculate the output value. As described in more detail below, the interpolation process may be performed within a sub-cube (Cube of Interest) of the input space. The number of cube corners required for interpolation depends on the interpolation scheme, but at worst case, it is all 8 corners (for example, in a tri-linear interpolation) that would need to be known.

The 3DLUT may be written in the form of N×N×N, where N is an integer designating the size of the 3DLUT, and the number of known points along each axis. The points along each of the three axes may be connected in a manner to create cubes, with the total number of cubes along each axis totaling (N−1). Therefore, for all three axes, the total number of cubes may total $(N-1)^3$. Since a cube contains 8 corner points, the total number of cube corner points would be $8*(N-1)^3$.

Consider an example of a 3×3×3 3DLUT for an 8 bit storage system (256 points along each axis). For a 3×3×3 3DLUT, each axis of R, G and B may store the points 0, 128 and 255 (storing three or "N" points along each axis instead of storing all points from 0 to 255). The total number of input points would be 3*3*3=27 (rather than $256^3$). For each of those 27 input points, an output value may be immediately determined. Also, the number of cubes along each axis would be (N−1), or (3−1) or 2 cubes. The total number of cubes for all three axes would be $(3\times1)^3=8$ cubes. The total number of cube corner points (since each cube contains 8 corners) would be $8*(3-1)^3=64$.

For every point that falls outside those known 27 points (or inside a particular "cube"), an interpolation process is used to determine the proper output value. Since only 27 points per output component are stored for a 3×3×3 3DLUT, rather than all 16,777,216 points, storage requirements are reduced. For a larger sized 3DLUT (e.g., a 17×17×17 point 3DLUT), more points would be stored, and hence less memory would be saved.

Large 3DLUT's require a lot of memory, and thus the storage requirements on a hardware die for a graphics processor for using many 3DLUT's quickly becomes prohibitive. To interpolate RGB color values within a 3D cube in a single clock cycle, up to eight corners of a particular 3D lattice are required simultaneously. Thus, to map one pixel per clock, up to 8 memory locations need to be addressed simultaneously. In current systems, this may be done by using as many as 8 memories on the die so that each memory is accessed during the same clock read cycle. However, these memories often include a lot of common content, resulting in large areas for implementation. An industry standard 17×17×17 interpolated look up table requires $17^3$ values, times at worst case 8 memories.

Figure 2:
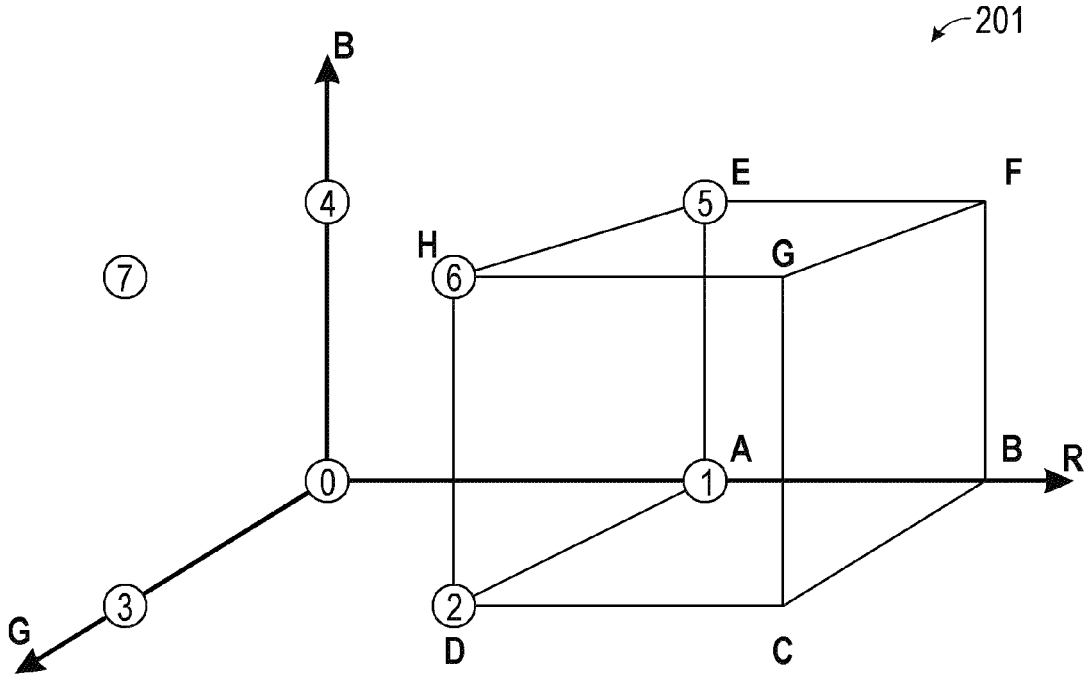
FIG. 2 is an illustration of a cube of interest adjacent to the cube of FIG. 1 according to one embodiment of the present invention.

Embodiments of the present invention relate to a system that can use a series of three dimensional lookup tables, wherein each table contains data specific to corners of a lattice of cubes, and each cube covers a particular subset of the entire color space. One example is a 2×2×2 lattice of cubes as shown in FIG. 2, which will be discussed in greater detail below. This configuration reduces the amount of memory space required on a chip die, because prior systems have duplicated the corner data for adjacent cubes since adjacent cubes share some of the same corners. These intermediate look up tables are formed in cubical space. For each sub-cube, an addressing method has been defined within embodiments of the invention such that a cube's uniqueness is maintained without a need for replicating redundant data for each cube.

As discussed above, for an N×N×N 3DLUT, there would be a total of $(N-1)^3$ cubes, and with 8 corners for each cube. Thus, the total number of cube corner points in this configuration would be $8*(N-1)^3$. However, for an adjacent cube, for example, sitting immediately next to another cube, four of the corner points would be in common between the adjacent cubes. In a conventional 3DLUT system, these common points would be stored separately even though they held the same values, wasting storage space by storing redundant data. Embodiments of the present invention therefore also relate to exploiting the shared common points for adjacent cubes, without re-storing them and thus saving storage space in memory.

Embodiments of the invention relate to an optimal way of assigning lattice corner data to a series of 8 tables, and a mechanism for mapping an input value to a lattice cube (Cube of Interest) and then determining which table and index within that table the corner data is located, such that all 8 corners are guaranteed to be in different tables, and all corner data is stored only once so there is no redundancy in the stored corner data. Described herein is a very efficient implementation that is possible if the lattice components span $2^n$ (two to the power of n) input values. For example, in the case used for illustration, an 8 bit 3D input space is represented as a 9×9×9 lattice. Thus each lattice segment spans 256/(9−1)=32 input values. Therefore, n=5 as each lattice segment covers $2^5$=32 input values.

FIG. 1 shows an exemplary mapping of a first lattice cube. The corners of the lattice cube are labeled A-H. Each corner is assigned a unique table, labeled 0-7. There are 8! possible mappings. Which mapping is chosen is irrelevant, but subsequent examples and diagrams assume the illustrated choice for convenience.

Referring to FIG. 2, consider a 3DLUT cube 201 placed immediately to the right on the "R" axis of the cube shown in FIG. 1. To interpolate values from the 3DLUT cube 201, it should be noted that some of the points in 3DLUT cube 201 are in common with points from the 3DLUT 101. As shown corner A of the 3DLUT cube 201 is the same point as corner B of 3DLUT 101 from FIG. 1. As discussed above, corner B of FIG. 1 is stored in Corner Value Table 1. Therefore, since corner A from the 3DLUT of FIG. 2 shares the same point as corner B of the 3DLUT in FIG. 1, corner A of the lattice cube in FIG. 2 may be read from Corner Value Table 1 of the 3DLUT 101. This allows systems implementing this table structure to save integrated chip die space within a graphics processor while also allowing the color space values corresponding to the corners of a cube to be read in a single clock cycle.

The lattice component, or sub-cube, containing the input RGB value is hereafter referred to as the Cube of Interest (CoI).

Figure 3:
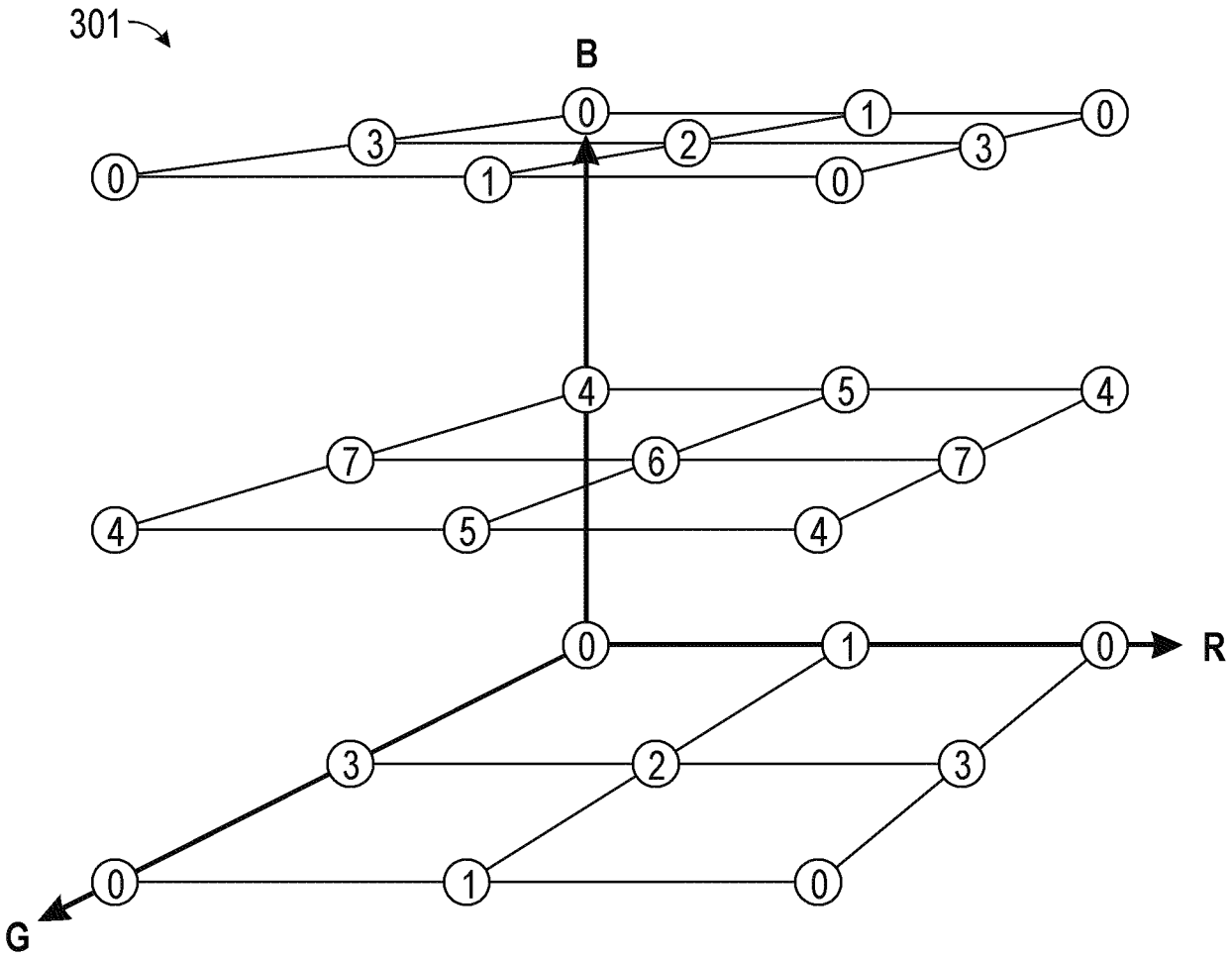
FIG. 3 is an illustration of a 2×2×2 lattice of cubes according to one embodiment of the present invention.
Figure 4:
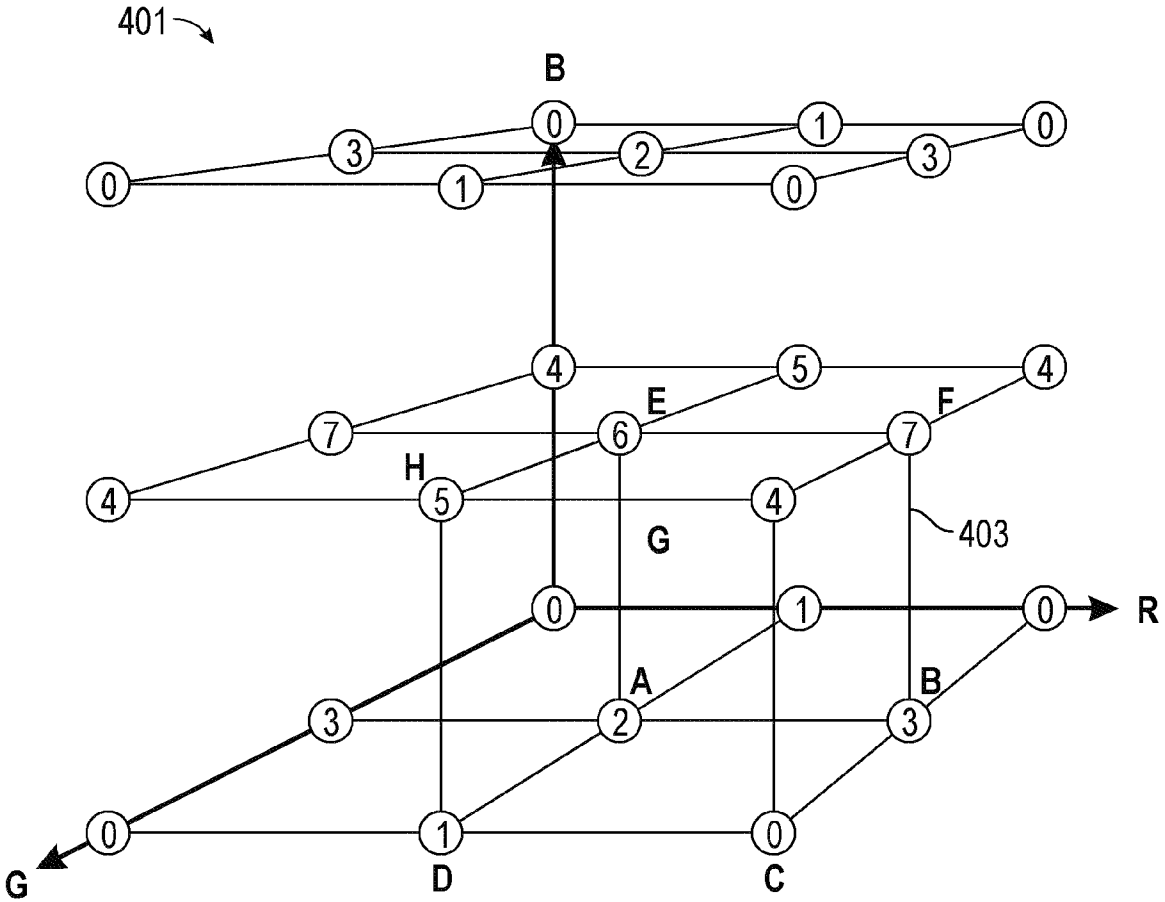
FIG. 4 is an illustration of a 2×2×2 lattice of cubes, with an example cube of R=1, G=1 and B=0 with indexing shown according to one embodiment of the present invention.

FIG. 3 is an illustration of the first 2×2×2 sub-lattice 301. The axis labels are the same as in FIG. 1 and FIG. 2. FIG. 3 shows that the assignment of tables to sub-cube corners repeats every 2×2×2 lattice elements. Thus the table containing any particular corner can be determined by where in the 2×2×2 sub lattice the sub cube resides. Furthermore, the position of the CoI is simply obtained by the $(n+1)^{th}$ bit (in the illustrated case, the $6^{th}$ bit) of the Red, Green and Blue input values, as shown in 501 of FIG. 5. This saves further die area as indexing logic is minimal. One such example is an 8×24 ROM as suggested in the figure. Embodiments also provide for further area reduction when one notes that half of the columns are simply the digital inversion of others.

In order to properly convert color values, a means to find a corner's value within a table is needed. The indexing scheme for embodiments of the invention is now described.

The input space can be considered to be subdivided into three levels. The smallest are the sub-cubes which span, as described earlier, $2^n$ input values along each axis. The middle level is the 2×2×2 sub lattices, each consisting of the eight sub-cubes described previously. The top most, or largest level, is the assemblage of 2×2×2 sub-lattices themselves. Each level of subdivision is directly inferred by bits in the input values. Bits 0 through n identify where within the CoI the actual input lies. For simplicity, these ranges are referred to as Cr, Cg and Cb ("Cx" generically) and can take on the values of 0 through $(2^n-1)$. In the illustrated example, n=5, therefor Cr, Cg and Cb can range from 0 to 31.

The second level, the position of the CoI within the 2×2×2 lattice, corresponds to the $(n+1)^{st}$ bit. These ranges are referred to as Lr, Lg and Lb ("Lx" generically). They can only take on the values of 0 or 1, and therefore Lr, Lg and Lb can identify one of the 8 sub cubes within the 2×2×2 sub lattice. As described earlier, in the illustrated example, this is the $6^{th}$ bit.

The top level corresponds to the n+2 and more significant bits. These ranges are referred to as SLr, SLg and SLb ("SLx" generically). The can range from 0 to $2^{(m-n-1)}-1$ where m is the bit size of the entire input space. In the illustrated example, m is 8 bits, n is 5 bits, so these ranges can vary from 0 to 3. Thus the entire illustrated input space can include 64 ($4^3$) 2×2×2 sub-lattices.

Indexing is achieved by a simple manipulation of SLx and using the results in a computation which is dependent on m-n (but is fixed for a particular implementation).

For each table, an entry value for red, green and blue inputs is determined. Let these 8 values be ar[i], ag[i], and ab[i] where i ranges from 0-7 to identify a particular table.

The values for ar, ag and ab are determined as follows:

| if Lr = 0 | if Lg = 0 | if Lb = 0 |
|---|---|---|
| ar[0] = Lr >> 1 | ag[0] = Lg >> 1 | ab[0] = Lb >> 0 |
| ar[1] = Lr >> 1 | ag[1] = Lg >> 1 | ab[1] = Lb >> 0 |
| ar[2] = Lr >> 1 | ag[2] = Lg >> 1 | ab[2] = Lb >> 0 |
| ar[3] = Lr >> 1 | ag[3] = Lg >> 1 | ab[3] = Lb >> 0 |
| ar[4] = Lr >> 1 | ag[4] = Lg >> 1 | ab[4] = Lb >> 0 |
| ar[5] = Lr >> 1 | ag[5] = Lg >> 1 | ab[5] = Lb >> 0 |
| ar[6] = Lr >> 1 | ag[6] = Lg >> 1 | ab[6] = Lb >> 0 |
| ar[7] = Lr >> 1 | ag[7] = Lg >> 1 | ab[7] = Lb >> 0 |
| **if Lr = 1** | **if Lg = 1** | **if Lb = 1** |
| ar[0] = (Lr + 1) >> 1 | ag[0] = (Lg + 1) >> 1 | ab[0] = (Lb + 1) >> 0 |
| ar[1] = (Lr − 1) >> 1 | ag[1] = (Lg + 1) >> 1 | ab[1] = (Lb + 1) >> 0 |
| ar[2] = (Lr − 1) >> 1 | ag[2] = (Lg − 1) >> 1 | ab[2] = (Lb + 1) >> 0 |
| ar[3] = (Lr + 1) >> 1 | ag[3] = (Lg − 1) >> 1 | ab[3] = (Lb + 1) >> 0 |
| ar[4] = (Lr + 1) >> 1 | ag[4] = (Lg + 1) >> 1 | ab[4] = (Lb − 1) >> 0 |
| ar[5] = (Lr − 1) >> 1 | ag[5] = (Lg + 1) >> 1 | ab[5] = (Lb − 1) >> 0 |
| ar[6] = (Lr − 1) >> 1 | ag[6] = (Lg − 1) >> 1 | ab[6] = (Lb − 1) >> 0 |
| ar[7] = (Lr + 1) >> 1 | ag[7] = (Lg − 1) >> 1 | ab[7] = (Lb − 1) >> 0 |

These manipulations are specific to the original choice of corner to table mapping. If a different choice is made, the manipulations to the red, green and blue entry values would be swapped.

Figure 6:
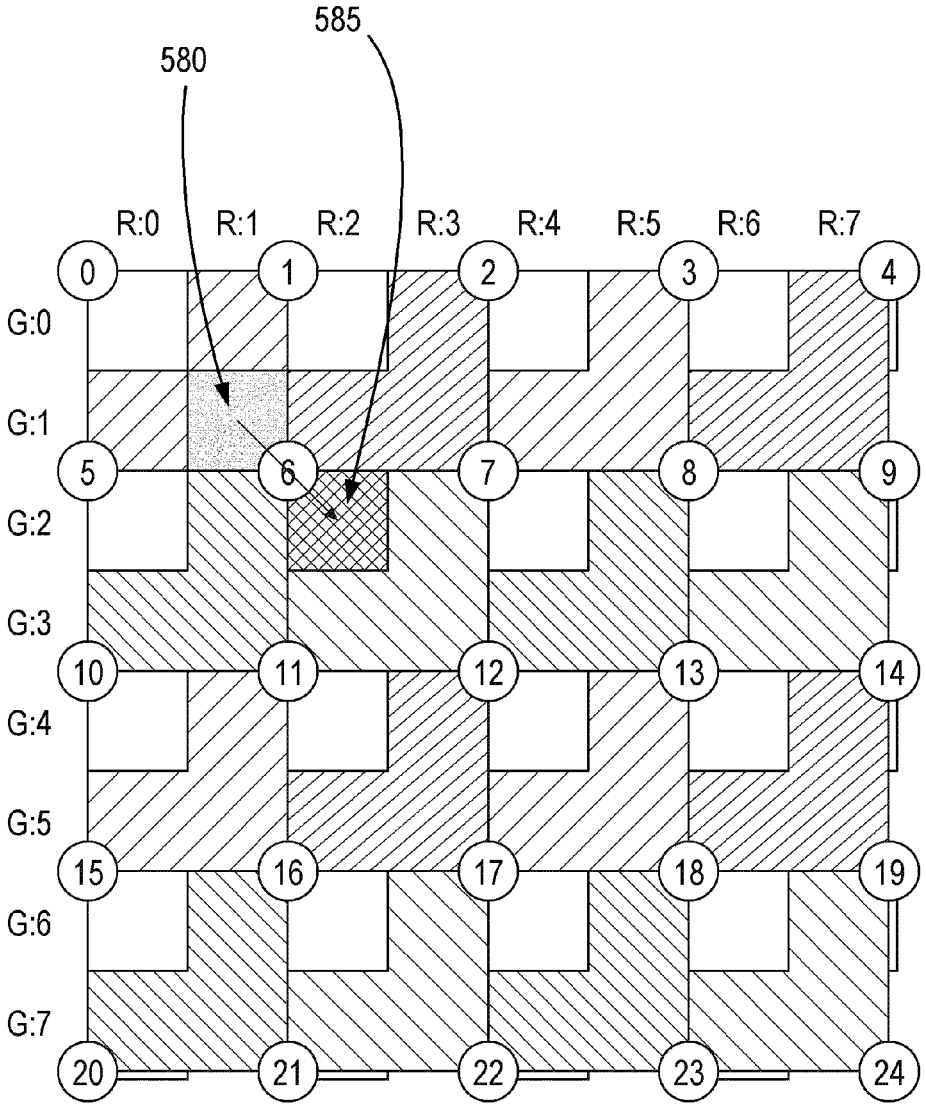
FIG. 6 is a block diagram of a corner cube translation from a first corner position to a second corner position according to one embodiment.
Figure 7A:
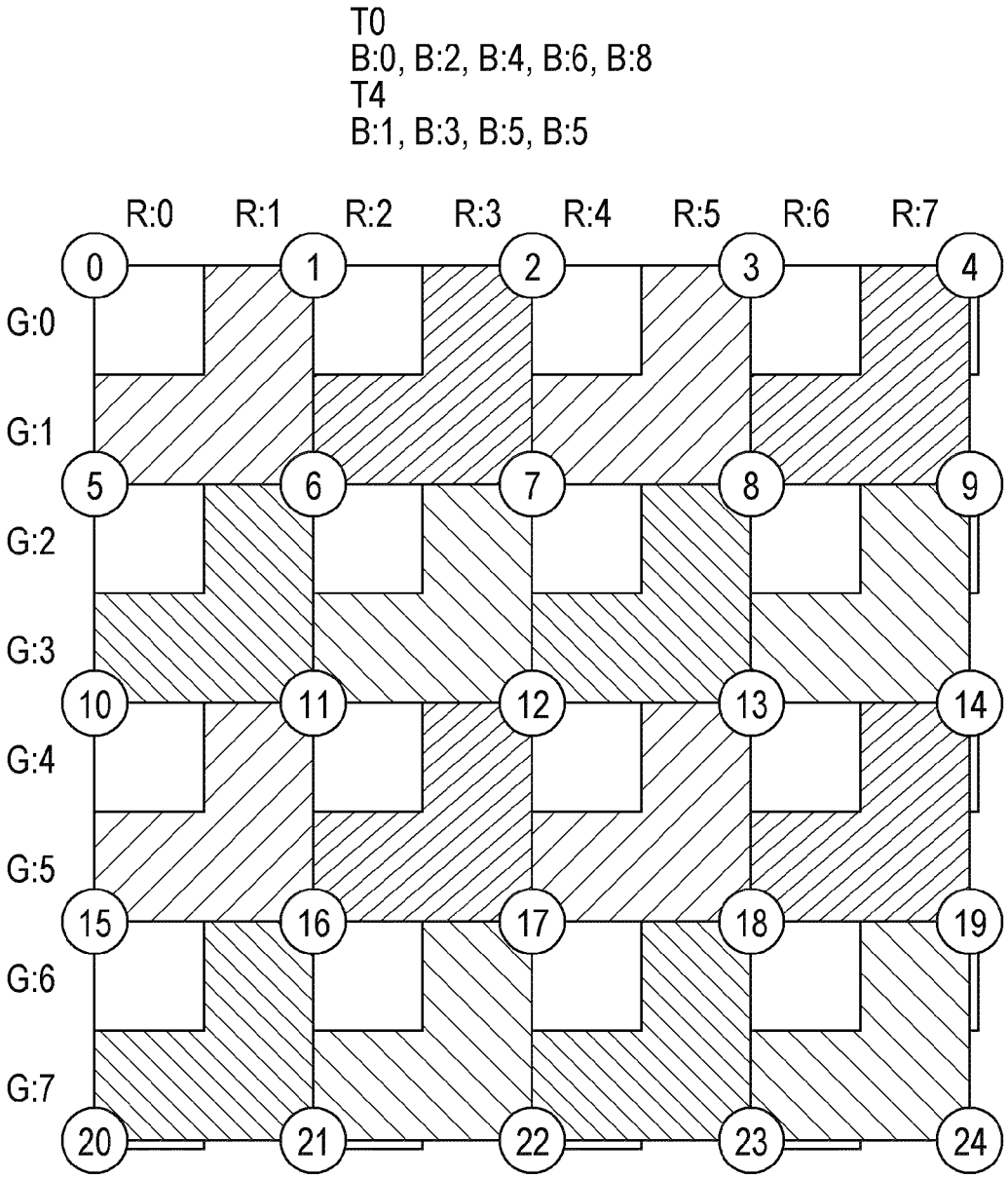
FIGS. 7A-D show block diagrams of exemplary table layouts according to certain embodiments.
Figure 7B:
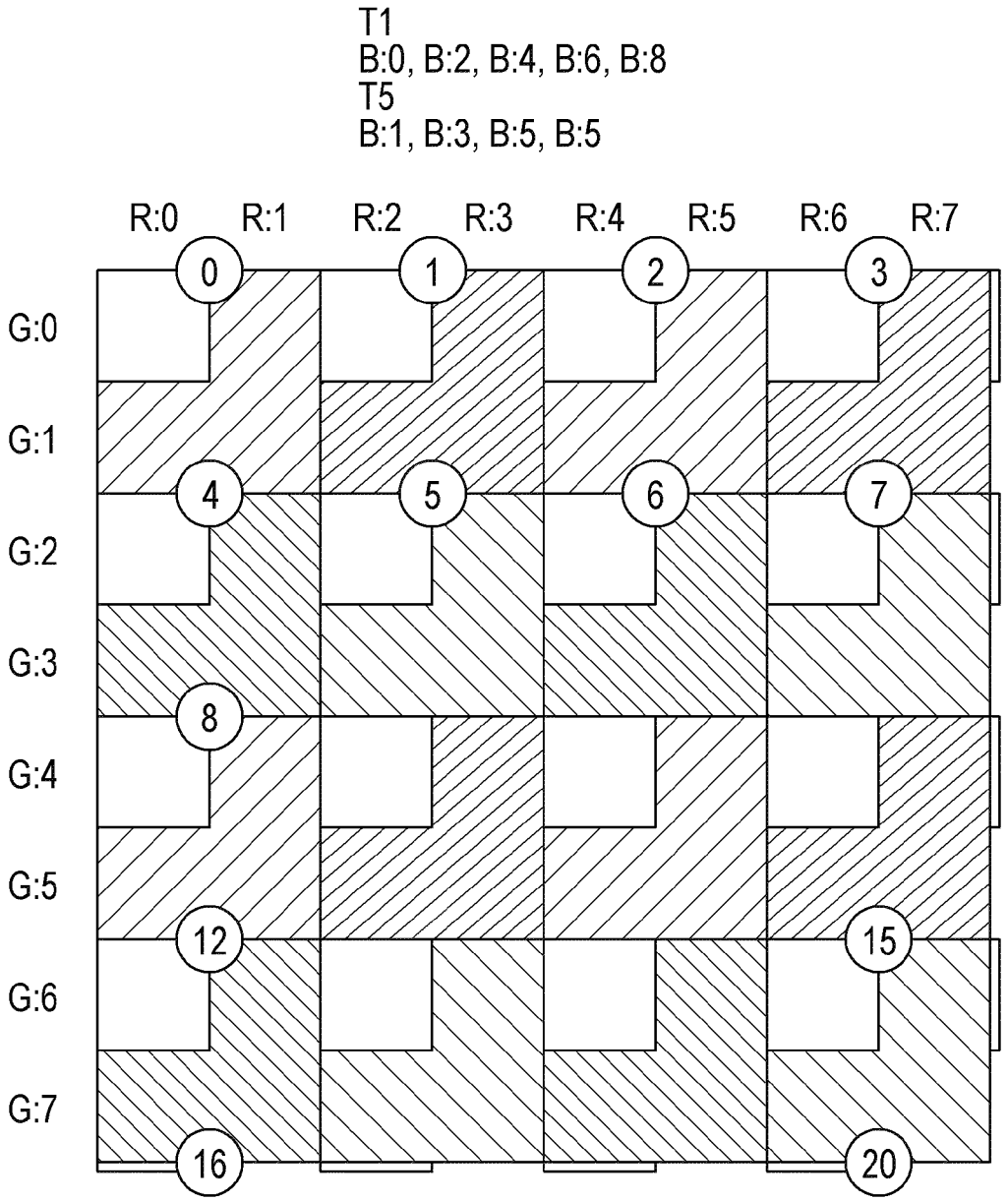
Figure 7C:
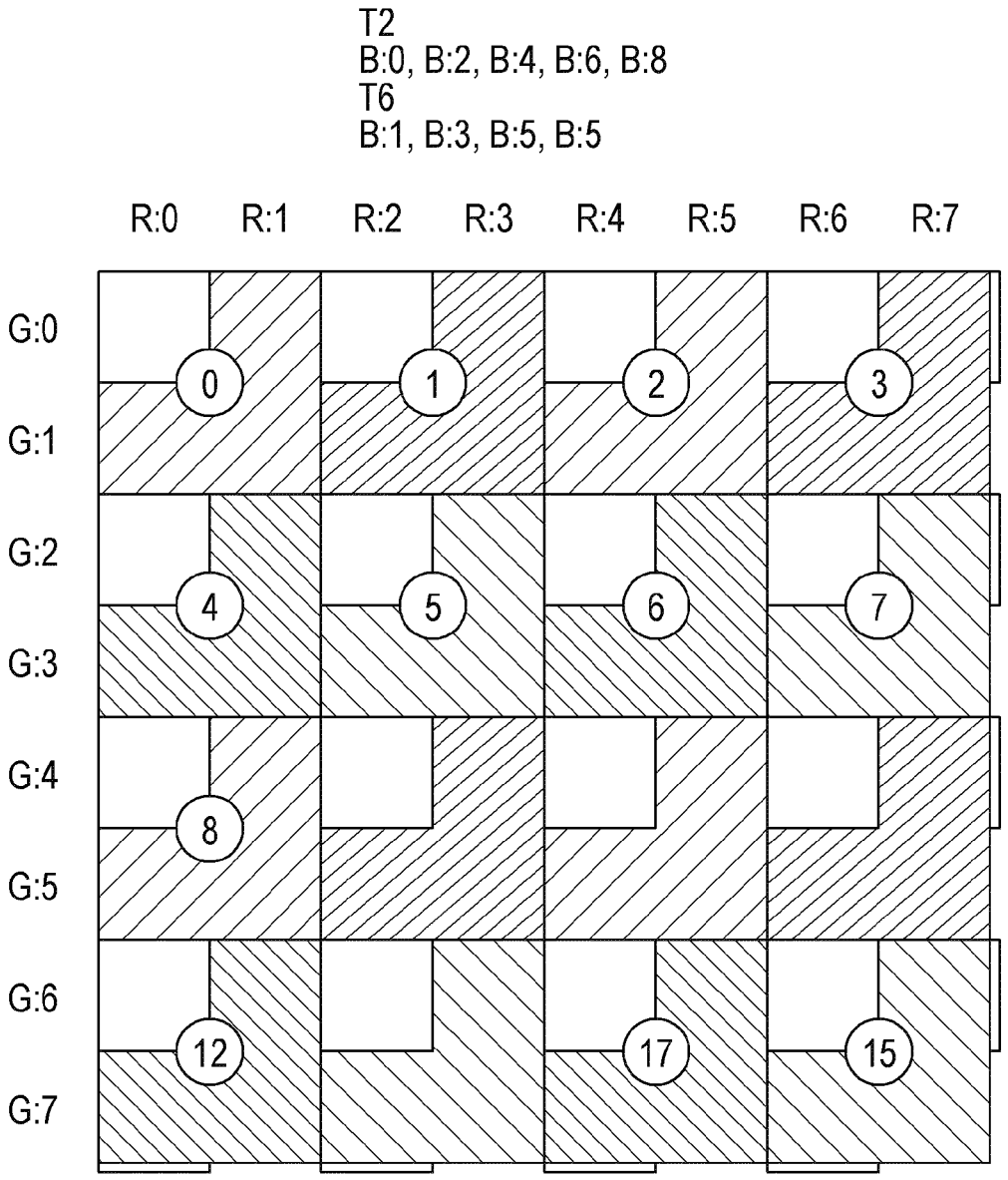
Figure 7D:
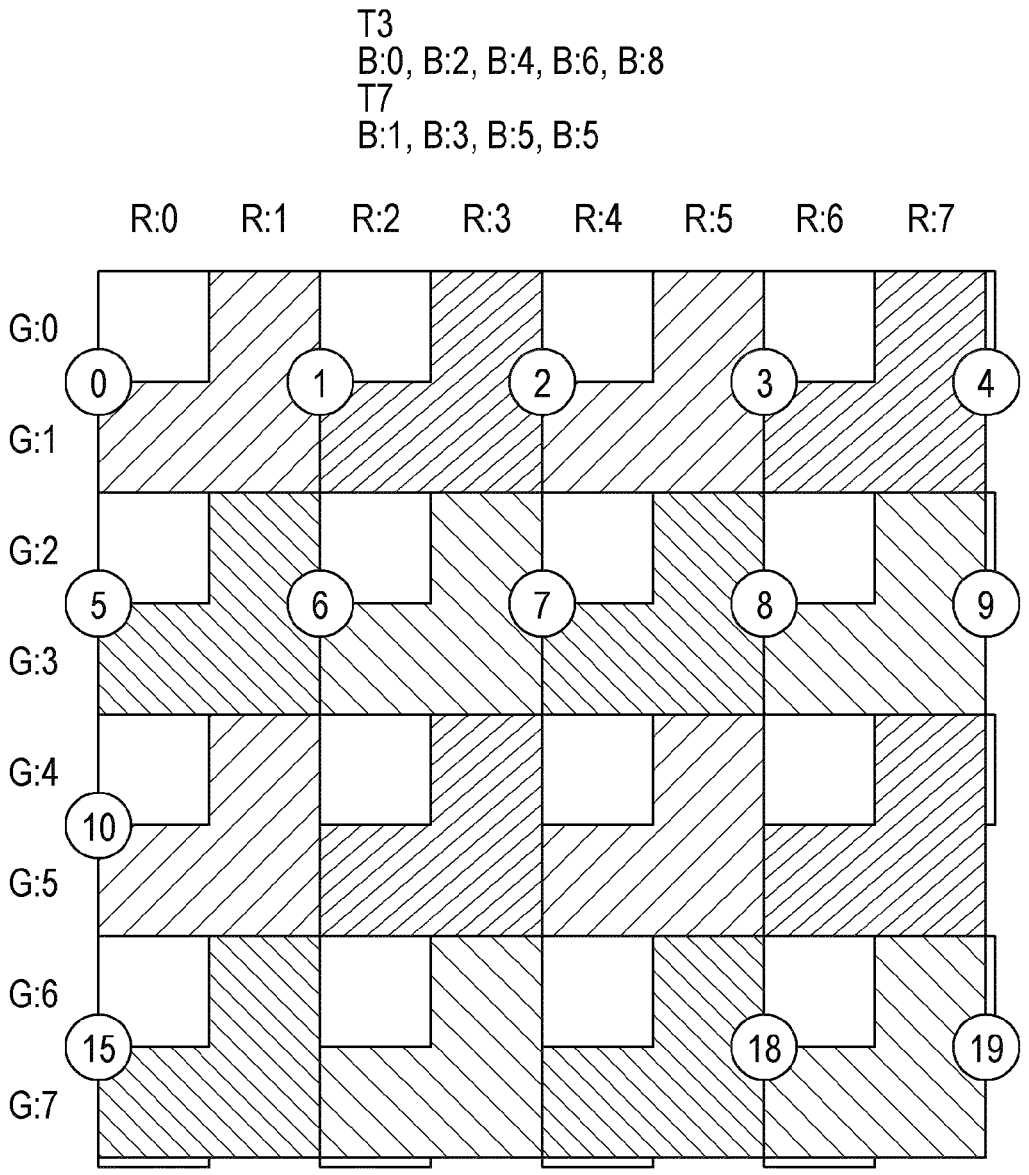

This manipulation translates the sub cube coordinates for a corner to the sub cube who's table contains the actual data. FIG. 6 graphically illustrates the translation. Shown is a blue cross section of the RGB cube, showing 4 lattice components in each of the red and green directions. Within each of the lattice components is further divided into 2×2×2 sub cubes. The circles show the first 25 data points of Table 0, which contain data for Corner A of all sub cubes. The cube within which we need to interpolate is shown as shaded. Although this table contains corner A values, it is seen that this cube's Corner C is the same as a diagonally adjacent corner A. To retrieve this corner value, we translate a cube 580 as shown in FIG. 6 to the corner position 585 (cross-hatching), according to the table described above. This is done for each corner. Note that the direction of translation depends on the corner being retrieved.

An index (or address) into each table is calculated. If the index into table i is represented as index[i], then the mechanism is as follows:

$$\text{index}[0]=(AA\times ab[0])+(DD\times ag[0])+ar[0]$$

$$\text{index}[1]=(BB\times ab[1])+(EE\times ag[1])+ar[1]$$

$$\text{index}[2]=(CC\times ab[2])+(EE\times ag[2])+ar[2]$$

$$\text{index}[3]=(BB\times ab[3])+(DD\times ag[3])+ar[3]$$

$$\text{index}[4]=(AA\times ab[4])+(DD\times ag[4])+ar[4]$$

$$\text{index}[5]=(BB\times ab[5])+(EE\times ag[5])+ar[5]$$

$$\text{index}[6]=(CC\times ab[6])+(EE\times ag[6])+ar[6]$$

$$\text{index}[7]=(BB\times ab[7])+(DD\times ag[7])+ar[7]$$

Where AA through EE are coefficients that depend on m−n−1, but are fixed for any particular instance of the 3D Lut. Let k=m−n−1. k=4 for the illustrated example, and is the number of 2×2×2 sub lattices that span each dimension of the input space.

The values of the coefficients are determined as follows:

$AA=(k+1)(k+1)=25$ in the illustrated example $BB=(k+1)k=20$ in the illustrated example $CC=k\times k=16$ in the illustrated example $DD=k+1=5$ in the illustrated example $EE=k=4$ in the illustrated example FIGS. 7A-7D show example table layouts where k=4, slicing the cubes on B planes, illustrating the first plane. For example, Table T0 (FIG. 7A) contains data for the B lattice planes 0, 2, 4, 6 and 8. Table A had 25 data points for each plane times 4 planes for a total of 100 data points. It is seen by inspection that the formulas described above provide for the correct index into the tables.

These manipulations are simple and synthesize to small logic areas. Again, if the original mapping of corners to tables is different, then the roles of the red, green and blue inputs are swapped.

Figure 8:
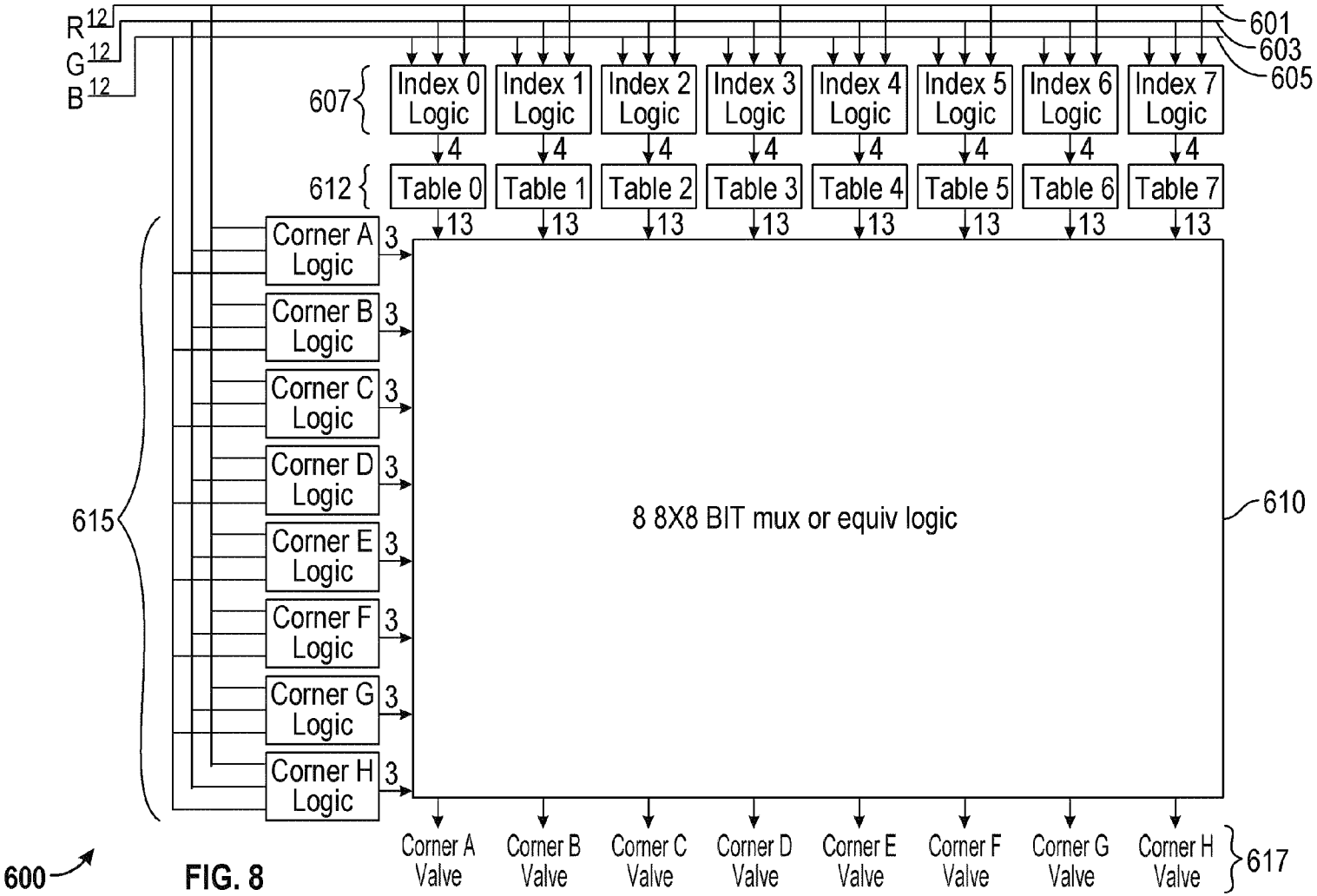
FIG. 8 is a block diagram of a system level overview according to one embodiment of the present invention.

FIG. 8 is a diagram showing an overview of a hardware process for retrieving data for the eight (8) corners of a cube of interest. Input 601 contains data from the red axis, 603 from the green axis, and 605 from the blue axis. The k most significant bits from each input axis are fed into a set of eight (8) indexing modules 607 for determining the index location in memory containing data for each corner of a cube of interest. Index block i implements the ar[i], ag[i] and ab[i] manipulations and the index[i] calculation described above. The output of the eight (8) indexing modules 607 input to eight (8) table modules 612 which store the corner values for the cube of interest.

Corner logic modules 615 are outputted to a mux hardware block 610. The hardware mux block simply steers the correct table value to the correct corner.

The least significant n bits of the Red, Green and Blue inputs represent the position of the input value within the lattice sub-cube. This data plus the output of the 8 corner values for the sub-cube are passed to the interpolation unit for final calculation of the final output value. The final output value is then calculated and returned.

The technology is operational with numerous other general purpose or special purpose computing system environments or configurations. Examples of well-known computing systems, environments, and/or configurations that may be suitable for use with the invention include, but are not limited to, personal computers, server computers, hand-held or laptop devices, multiprocessor systems, processor-based systems, programmable consumer electronics, network PCs, minicomputers, mainframe computers, distributed computing environments that include any of the above systems or devices, and the like.

As used herein, instructions refer to computer-implemented steps for processing information in the system. Instructions can be implemented in software, firmware or hardware and include any type of programmed step undertaken by components of the system.

A processor may be any conventional general purpose single- or multi-chip processor such as a Pentium® processor, a Pentium® Pro processor, a 8051 processor, a MIPS® processor, a Power PC® processor, or an Alpha® processor. In addition, the processor may be any conventional special purpose processor such as a digital signal processor or a graphics processor. The processor typically has conventional address lines, conventional data lines, and one or more conventional control lines.

The system is comprised of various modules as discussed in detail. As can be appreciated by one of ordinary skill in the art, each of the modules comprises various sub-routines, procedures, definitional statements and macros. Each of the modules are typically separately compiled and linked into a single executable program. Therefore, the description of each of the modules is used for convenience to describe the functionality of the preferred system. Thus, the processes that are undergone by each of the modules may be arbitrarily redistributed to one of the other modules, combined together in a single module, or made available in, for example, a shareable dynamic link library.

The system may be used in connection with various operating systems such as Linux®, UNIX® or Microsoft Windows®.

The system may be written in any conventional programming language such as C, C++, BASIC, Pascal, or Java, and ran under a conventional operating system. C, C++, BASIC, Pascal, Java, and FORTRAN are industry standard programming languages for which many commercial compilers can be used to create executable code. The system may also be written using interpreted languages such as Perl, Python or Ruby.

Those of skill will further appreciate that the various illustrative logical blocks, modules, circuits, and algorithm steps described in connection with the embodiments disclosed herein may be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present disclosure.

The various illustrative logical blocks, modules, and circuits described in connection with the embodiments disclosed herein may be implemented or performed with a general purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general purpose processor may be a microprocessor, but in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration.

In one or more example embodiments, the functions and methods described may be implemented in hardware, software, or firmware executed on a processor, or any combination thereof. If implemented in software, the functions may be stored on or transmitted over as one or more instructions or code on a computer-readable medium. Computer-readable media include both computer storage media and communication media including any medium that facilitates transfer of a computer program from one place to another. A storage medium may be any available media that can be accessed by a computer. By way of example, and not limitation, such computer-readable media can comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer. Also, any connection is properly termed a computer-readable medium. For example, if the software is transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium. Disk and disc, as used herein, includes compact disc (CD), laser disc, optical disc, digital versatile disc (DVD), floppy disk and Blu-ray disc where disks usually reproduce data magnetically, while discs reproduce data optically with lasers. Combinations of the above should also be included within the scope of computer-readable media.

The foregoing description details certain embodiments of the systems, devices, and methods disclosed herein. It will be appreciated, however, that no matter how detailed the foregoing appears in text, the systems, devices, and methods can be practiced in many ways. As is also stated above, it should be noted that the use of particular terminology when describing certain features or aspects of the invention should not be taken to imply that the terminology is being redefined herein to be restricted to including any specific characteristics of the features or aspects of the technology with which that terminology is associated.

It will be appreciated by those skilled in the art that various modifications and changes may be made without departing from the scope of the described technology. Such modifications and changes are intended to fall within the scope of the embodiments. It will also be appreciated by those of skill in the art that parts included in one embodiment are interchangeable with other embodiments; one or more parts from a depicted embodiment can be included with other depicted embodiments in any combination. For example, any of the various components described herein and/or depicted in the Figures may be combined, interchanged or excluded from other embodiments.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

While various aspects and embodiments have been disclosed herein, other aspects and embodiments will be apparent to those skilled in the art. The various aspects and embodiments disclosed herein are for purposes of illustration and are not intended to be limiting.

What is claimed is:

1. A method of mapping an input color space to an output color space comprising:

receiving an input point corresponding to a first pixel to be converted from the input color space to the output color space, the input point corresponding to an input value in the input color space;

calculating a number of most significant bits of each input value based at least on a bit size of the input color space and a number of input values in the input color space;

providing a plurality of tables comprising data coordinates corresponding to corners within a plurality of three dimensional cubes in a lattice and color transformation data associated with each corner, wherein each corner data coordinate is represented in only one table;

determining which of the plurality of tables in the lattice contains data for the corners of a cube of interest having the input point, the determination based at least on the bit size of the input color space and the number of input values in the input color space;

calculating an index for each of the plurality of tables containing data for the corners of the cube of interest, each index calculated based on the number of most significant bits of each input value; and accessing the color transformation data for the cube of interest using the index for each of the plurality of tables.

2. The method of claim 1, wherein accessing the color transformation data comprises accessing 3D look up tables.

3. The method of claim 1, wherein the lattice comprises a 2×2×2 pattern of 3D lookup tables.

4. The method of claim 3, wherein the 2×2×2 pattern repeats for every 2×2×2 cube of interest.

5. The method of claim 1, wherein the lattice comprises 3 coordinate axes for red, green and blue.

6. The method of claim 1, further comprising interpolating the color transformation data to provide output color space values for the input point.

7. An integrated circuit for transforming input color space representations into output color space representations, comprising:

a memory, comprising:

a plurality of tables comprising data coordinates corresponding to corners within a plurality of three dimensional cubes in a lattice and color transformation data associated with each corner, wherein each corner data coordinate is represented in only one table; and one or more processors configured to:

calculate a number of most significant bits of each input value based at least on a bit size of the input color space and a number of input values in the input color space;

receive an input point corresponding to a first pixel to be converted from an input color space to the output color space, the input point corresponding to an input value in the input color space;

determine which of the plurality of tables in the lattice contains data for the corners of a cube of interest having the input point, the determination based at least on the bit size of the input color space and the number of input values in the input color space;

calculate an index for each of the plurality of tables containing data for the corners of the cube of interest, each index calculated based on the number of most significant bits of each input value; and determine color transformation data for the cube of interest using the index for each of the plurality of tables.

8. The integrated circuit of claim 7, wherein the integrated circuit is a graphics processor.

9. The integrated circuit of claim 7, wherein the data coordinates comprise corners of a 3D lookup table.

10. The integrated circuit of claim 7, wherein the integrated circuit further comprises instructions for interpolating the color transformation data to provide output color space values for the input point.

11. The integrated circuit of claim 7, wherein the lattice comprises 3 coordinate axes for red, green and blue.

12. The integrated circuit of claim 7, wherein the input point is in a RGB color space.

13. The integrated circuit of claim 12, wherein the determined color transformation data is in a CMYK color space.

14. A system for mapping an input color space to an output color space comprising:

means for receiving an input point corresponding to a first pixel to be converted from the input color space to the output color space, the input point corresponding to an input value in the input color space;

means for calculating a number of most significant bits of each input value based at least on a bit size of the input color space and a number of input values in the input color space;

means for providing a plurality of tables comprising data coordinates corresponding to corners within a plurality of three dimensional cubes in a lattice and color transformation data associated with each corner, wherein each corner data coordinate is represented in only one table;

means for using at least the bit size of the input color space and the number of input values in the input color space to determine which of the plurality of tables in the lattice contains data for the corners of a cube of interest having the input point;

means for calculating an index for each of the plurality of tables containing data for the corners of the cube of interest, each index calculated based on the number of most significant bits of each value; and means for accessing the color transformation data for the cube of interest using the index for each of the plurality of tables.

15. The system of claim 14, wherein the input point is in a RGB color space.

16. The system of claim 15, wherein the color transformation data is in a CMYK color space.

17. The system of claim 14, further comprising means for interpolating the color transformation data to provide output color space values for the input point.

18. The system of claim 14, wherein the system comprises a mobile electronic device having a graphics processing engine.

* * * * *